US006015256A

United States Patent [19]

Mesa et al.

[11] Patent Number: 6,015,256

[45] Date of Patent: Jan. 18, 2000

[54] WHEELCHAIR TILTING DEVICE AND METHOD OF TILTING A WHEELCHAIR

[76] Inventors: Carlos Mesa; Maritza Mesa, both of P.O. Box 1405, Pearland, Tex. 77588

[21] Appl. No.: 09/232,435

[22] Filed: Jan. 15, 1999

[51] Int. Cl.[7] ..... A61G 7/010

[52] U.S. Cl. ..... 414/678; 414/921

[58] Field of Search ..... 414/678, 921, 414/800

[56] References Cited

U.S. PATENT DOCUMENTS

| | | | |
|---|---|---|---|
| 3,476,404 | 11/1969 | Rachman | 414/678 |
| 4,389,056 | 6/1983 | Tenniswood | 414/678 |
| 4,725,188 | 2/1988 | Zimmerman et al. | 414/678 |
| 4,726,730 | 2/1988 | McConnell | 414/678 |
| 4,790,716 | 12/1988 | McConnell | 414/678 |
| 4,830,567 | 5/1989 | Rachman | 414/921 X |
| 4,941,799 | 7/1990 | Gordon et al. | 414/678 |
| 5,007,118 | 4/1991 | Ebersole | 414/678 X |
| 5,040,939 | 8/1991 | Booth | 414/678 |
| 5,421,693 | 6/1995 | Peterson | 414/678 |

*Primary Examiner*—Janice L. Krizek
*Attorney, Agent, or Firm*—Gilbreth & Strozier, P.C.

[57] ABSTRACT

Disclosed is a device and method for comfortably tilting a wheelchair and its occupant to a reclining position such as required for receiving common services such as having their hair done or dental work performed.

17 Claims, 11 Drawing Sheets

WHEELCHAIR TILTING DEVICE AND METHOD OF TILTING A WHEELCHAIR

BACKGROUND OF THE INVENTION

1. Field of the Invention

The present invention relates to an apparatus and method for tilting wheelchairs. In another aspect, the present invention relates to an apparatus and method for reclining wheelchairs. In even another aspect, the present invention relates to a portable, lightweight and easy to manufacture apparatus and method for reclining a wheelchair. In still another aspect, the present invention relates to a portable, lightweight and easy to manufacture apparatus and method for reclining a wheelchair that is readily assembled and disassembled for transportation and storage.

2. Description of the Related Art

Many common services such as hair care or dental work require a person to be placed in a reclining position. However, people confined to wheelchairs often experience pain or difficulty when trying to recline to an angle necessary to have their hair shampooed or their teeth cleaned. Often times, such people are also incapable of assisting a beautician, dentist or other care provider in achieving the necessary reclined position.

In addition, physically lifting a wheel chair bound person to a reclining chair such as those used by hair dressers or dentists is generally awkward and potentially dangerous for both the person and the service provider.

There have been several attempts in the prior art to provide a device for tilting or reclining a wheel chair.

U.S. Pat. No. 4,725,188, issued Feb. 16, 1988 to Zimmerman, et al, discloses an article of furniture that is provided for receiving a wheelchair and extending the wheelchair functions, the article of furniture including track rail members having upwardly opening concave tracks which extend rearwardly from a lowermost point to a first slightly raised position and then extend along curved paths in an arc having about the same or slightly larger radius of curvature as the large wheels of the wheelchair to be accommodated. Thus, a wheelchair may be backed along the concave tracks to "detent" over the first position to safely "bed" the wheelchair. Also included is a tilt frame against which the rear of the wheelchair bears and a head rest carried in an upper portion of the tilt frame. A controllable rearward reclining position may be assumed by actuating (alternatively, manually or power assisted) a lift mechanism which raises pads supporting the small front wheels of the wheelchair such that the entire wheelchair, as well as the tilt frame, rotates about the axis of the large wheels. When the desired reclining position is reached, the person in the wheelchair may rest at ease and in complete security with his head against the headrest. The process is reversed when it is desired to remove the wheelchair from the assembly.

U.S. Pat. No. 4,726,730, issued Feb. 23, 1988 to McConnell, discloses a device for selectively lifting and tilting a wheelchair and its occupant to a convenient position for convenient performance of a service such as dental work upon the occupant of the wheelchair. The device includes a base, a platform, a support frame attached between said base and platform, a reversible motor and jack mechanism attached between the base and support frame for lifting or lowering the support frame, a reversible motor and actuator mechanism attached between the support frame and the platform for tilting the platform in a desired direction, safety belts for securing the wheelchair and its occupant to the platform, and two sets of switches for selected actuation of the device, one of which may be operated by hand and the other being foot-controlled.

U.S. Pat. No. 4,790,716, issued Dec. 13, 1988 to McConnell, discloses a device for selectively lifting and tilting a wheel chair and its occupant to a convenient position for performance of a service, such as a dental work or beauty salon work, upon the occupant of the wheelchair. An alternative embodiment of the invention is wheelchair handling device, which is disclosed in figures, inclusive. The device includes a housing, wheelchair receptacle, backrest, wheels and a foot-operated control box having dual footpad switch for tilting the receptacle forward and backward. A switch operates a motor-driven lift system, which includes a pair of scissors jacks and vertical worm gears driven by a chain and reversible motor. A motor-driven tilting system, includes a reversible electric motor driving a worm gear and a worm gear follower pivotally attached to the wheelchair receptacle. Accessories include a wash basin and wash basin bracket with support adjustably attached to a backrest frame.

U.S. Pat. No. 4,941,799, issued Jul. 17, 1990, to Gordon, et al, discloses a height and tilt adjustable wheelchair support which has a stationary base with a main support leg thereon. A platform for receiving a wheelchair and the platform is connected to the main support leg via a chassis, and is vertically movable via a length extendable cylinder connected between the base and the chassis. A second length-adjustable cylinder rotates the wheelchair supporting platform relative to the chassis around a pivot such that the wheelchair can be raised, lowered, or tilted, via independent controls.

U.S. Pat. No. 5,040,939, issued Aug. 20, 1991 to Booth, discloses a wheelchair lift for tilting a wheelchair and occupant backwards to a position for having his or her hair dressed or dental work or the like performed. The wheelchair lift includes a pivotable frame onto which the wheelchair is rolled and secured. The lift also includes a fixed frame, a telescoping arm pivotally attached to the fixed frame and to the rear of the pivotable frame, and an electric motor drive which retracts and extends the telescoping arm to pivot the pivotable frame and wheelchair attached thereto about a pivot axis where the pivotable frame and the fixed frame are connected. The pivotable frame includes a horizontal section and an upright section which are connected at the pivot axis. The upright section includes a headrest which is adjustable. In one position the head rest supports the head of the occupant to allow work such as dental work to be performed while in a second position the headrest is retracted beneath the level of the wheelchair to allow free movement of the occupant's head to permit hair-washing and the like.

U.S. Pat. No. 5,421,693, issued Jun. 6, 1995 to Petersen, discloses a wheelchair tilting apparatus which includes a base assembly and a wheelchair receiving assembly supported by the base assembly. The wheelchair receiving assembly includes a first platform portion and a first frame assembly supporting the first platform portion. The wheelchair receiving assembly also includes a second platform portion and a second frame assembly supporting the second platform portion. The first and second frame assemblies are connected to each other and oriented with respect to each other at a predetermined obtuse angle, such that the first and second platform portions are oriented with respect to each other at the predetermined obtuse angle. A tilt assembly is supported by the base assembly and is provided for tilting the wheelchair receiving assembly after a wheelchair is received in the wheelchair receiving assembly. The tilt assembly includes an electric motor and a gear assembly that is connected to the wheelchair receiving assembly, such that the tilt assembly controls a tilt angle of the wheelchair receiving assembly and the wheelchair supported thereon. Wheel assemblies are connected to bottom portions of the base assembly. A wheel-stop assembly is connected to the first platform portion for preventing rolling of the wheelchair when the wheelchair is resting on the first platform portion. A wheelchair backstop assembly is connected between respective first and second side frame assemblies that are connected respectively to the first and second frame assemblies. A headrest assembly is also connected between the first and second side frame assemblies.

However, in spite of these advancements in the prior art, there is still a need for an improved apparatus for tilting a wheelchair.

There is another need in the art to facilitate the ability of a wheelchair bound person to comfortably achieve a desired angle of reclination required to receive common services or treatment.

There is even another need in the art to provide a simple and easy to manufacture system to recline a wheelchair so that the user is kept comfortable during reclination and while in a reclined position.

There is still another need in the art to provide a light weight and portable system to recline a wheelchair so that a wheel chair bound person is kept comfortable during reclination and while in a reclined position.

These and other needs in the art will become apparent to those of skill in the art upon review of this specification, including its drawings and claims.

SUMMARY OF THE INVENTION

It is an object of the present invention to provide for an improved apparatus for tilting a wheelchair.

It is another object of the present invention to provide a device to facilitate the ability of a wheelchair bound person to comfortably achieve a desired angle of reclination required to receive common services or treatment.

It is even another object of the present invention to provide for a simple and easy to manufacture system to recline a wheelchair so that the user is kept comfortable during reclination and while in a reclined position.

It is still another object of the present invention to provide a light weight and portable system to recline a wheelchair so that a wheel chair bound person is kept comfortable during reclination and while in a reclined position.

These and other objects of the present invention will become apparent to those of skill in the art upon review of this specification, including its drawings and claims.

In one embodiment of the present invention there is provided a device for pivoting a wheelchair which includes at least one rear wheel immobilizer for securing at least one rear wheel of the wheelchair; a tilting assembly with a securing member for receiving a portion of the handle frame of the wheelchair; and a drive mechanism attached to the tilting assembly for extending or retracting the tilting assembly. When a wheel chair is secured to the device, the immobilized wheel acts as a pivot point such that when the tilting assembly is retracted the wheelchair pivots backwards on the axle to a reclining position and when the tilting assembly is extended the wheelchair returns on the axle to an upright position.

In another embodiment, there is provided another device for pivoting a wheel chair, which includes two wheel immobilizers, each secured to a track where the tracks are slidably engaged to each other such that the distance between the tracks may be adjusted, for securing the rear wheels of the wheelchair to form two immobilized rear wheelchair wheels; a tilting assembly including at least one securing member for receiving the handle grips of the wheelchair; and a drive mechanism comprising an electric motor attached to the tilting assembly for extending or retracting the tilting assembly. When the handle grips of the wheel chair are secured into the tilting assembly, the immobilized rear wheels act as a pivot point such that when the tilting assembly is retracted the wheelchair pivots backwards on the axle to a reclining position and when the tilting assembly is extended the wheelchair returns on the axle to an upright position.

In even another embodiment, there is provided a method for pivoting a wheel chair. The method includes immobilizing at least one rear wheel of the wheel chair with at least one wheel immobilizer; attaching a portion of the handle frame of the wheelchair to at least one tilting arm; retracting the tilting arm with a drive mechanism such that the wheel chair pivots about the wheel axle and that the immobilized wheel chair wheel acts as a fulcrum to position the wheelchair in a reclining position; and returning the wheel chair to an upright position by extending the tilting assembly.

These and other embodiments of the present invention will become apparent to those of skill in the art upon review of this specification, including its drawings and claims.

DETAILED DESCRIPTION OF THE INVENTION

The new wheelchair tilting devices and methods of tilting a wheelchair of the present invention utilize adjustable clamps to secure the frame or handle grips of a wheel chair to tilting arm or arms. The large wheels of the wheelchair are then clamped or otherwise held in place on a floor or other stationary base. With the large chair wheels so secured they provide a fulcrum for the chair's wheel axle to pivot upon when the tilt bar is extended or retracted. Referring now to FIGS. 1–16, the wheelchair tilting devices of the present invention and there operation will be shown and described in detail. Like numbers will be used to refer to like components throughout the discussion of the figures.

Figure 1:
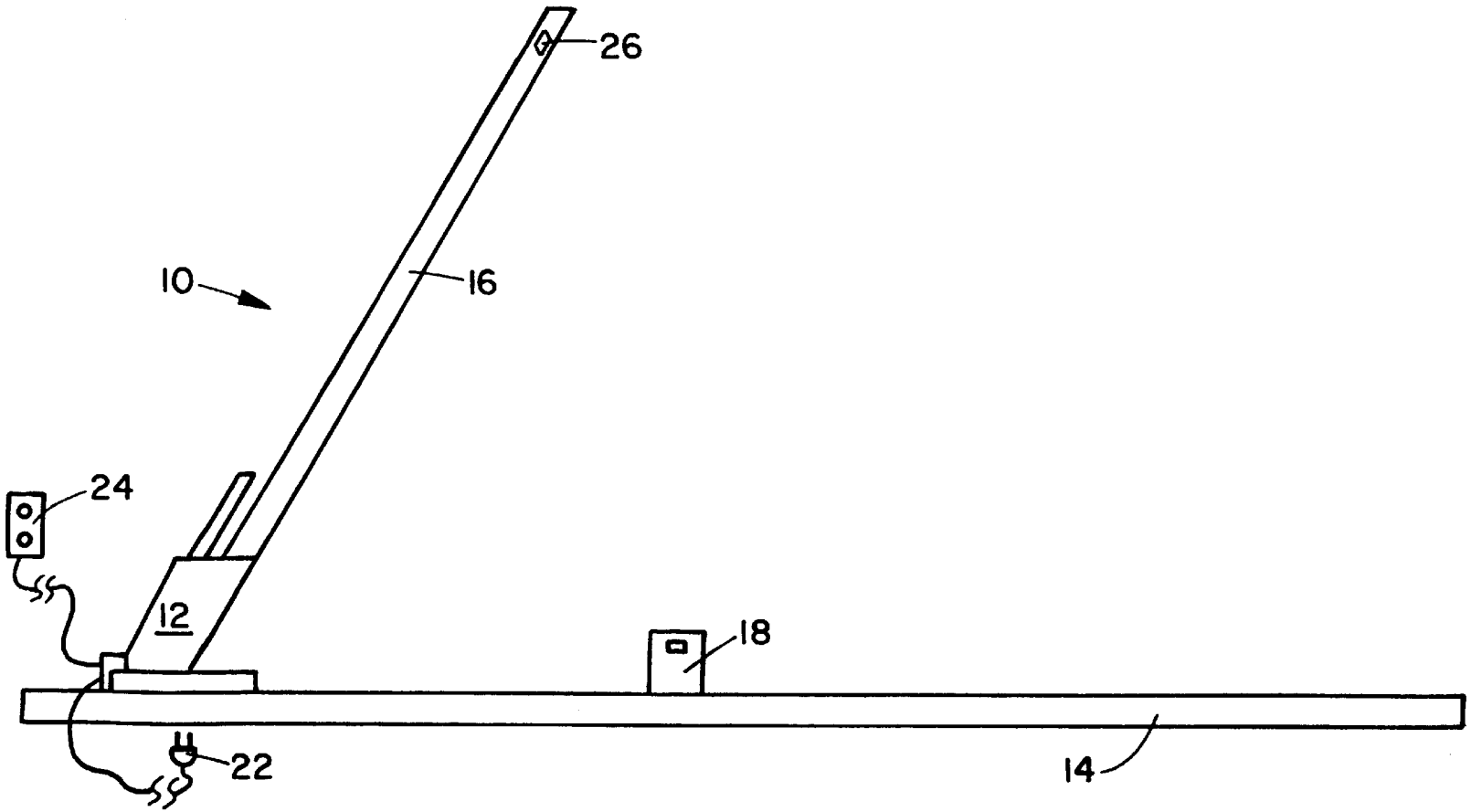
FIG. 1 is a side view of one embodiment of wheel chair tilting apparatus 10 having drive motor 12, tilt bars 16, wheelchair frame locks 26 and wheel locks 18.
Figure 2:
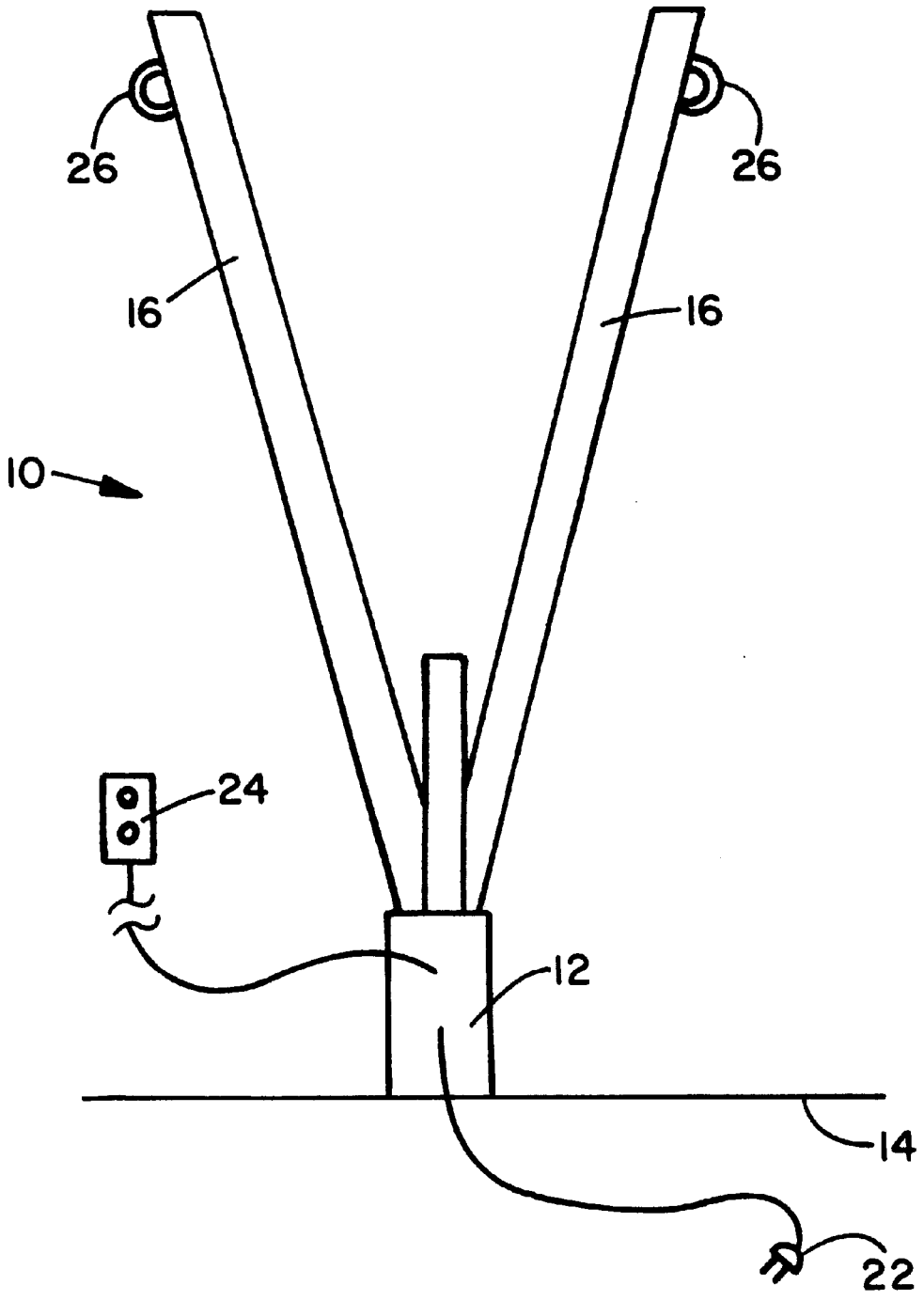
FIG. 2 is a rear view of wheel chair tilting apparatus 10 of FIG. 1.
Figure 3:
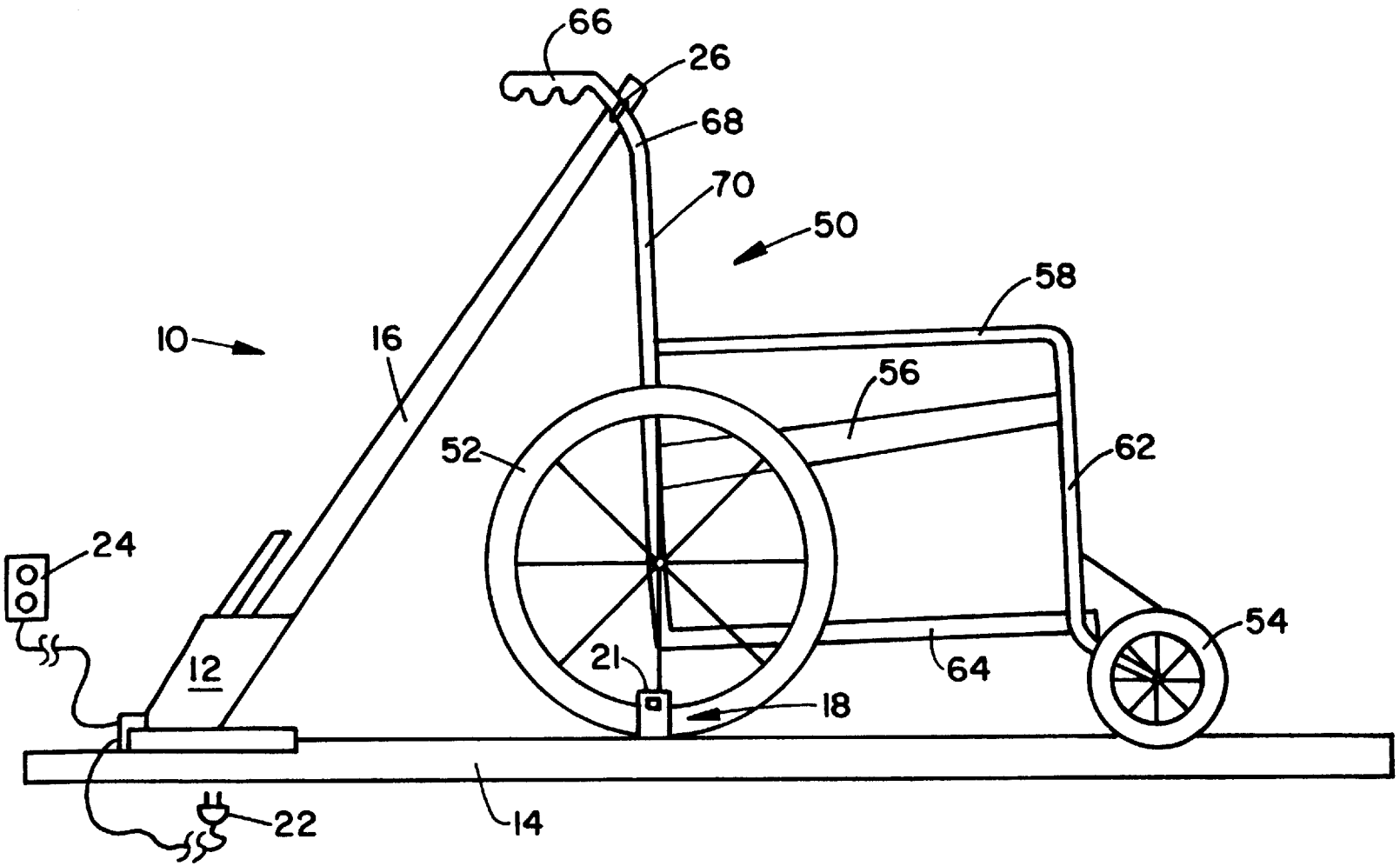
FIG. 3 is a side view of tilting device 10 with wheel chair 50 in an upright position.
Figure 4:
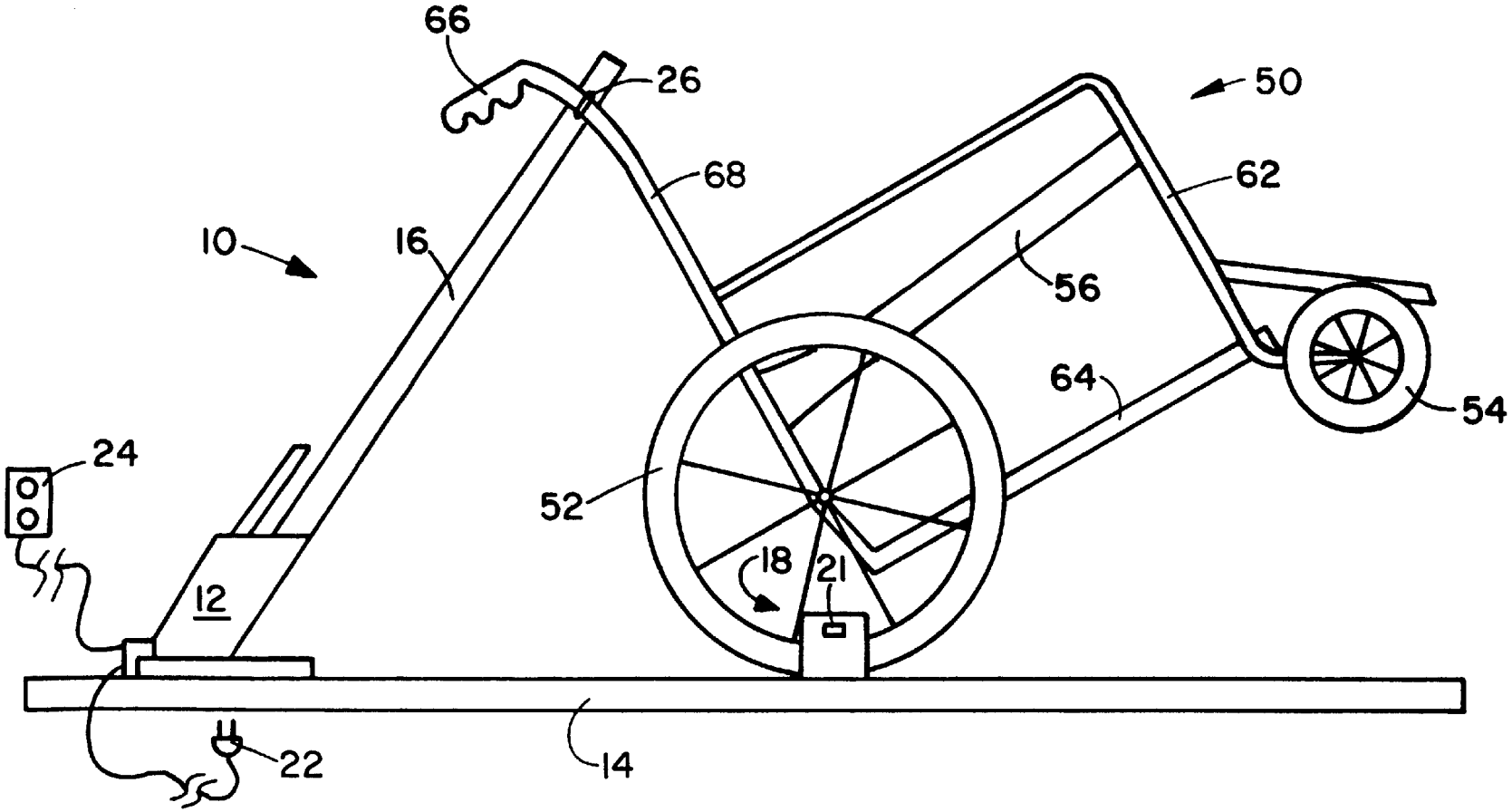
FIG. 4 is a side view of tilting device 10 with wheel chair 50 in a reclined position.

Referring to FIGS. 1–4, there is shown one embodiment of a wheelchair tilting device of the present invention. FIG. 1 is a side view of tilting device 10, FIG. 2 is a rear view of tilting device 10 of FIG. 1, FIG. 3 is a side view of tilting device 10 with wheel chair 50 in an upright position, and FIG. 4 is a side view of tilting device 10 with wheel chair 50 in a reclined position.

Referring to FIGS. 3 and 4, tilting device 10 is designed to be used with any conventional wheel chair shown in the figures generally as 50. Wheel chair 50 generally includes rear wheels 52, steering wheels 54, seat 56, back rest 70, arm rest 58, frame members 62 and 64, handles 66, and handle frame member 68.

Referring to FIG. 1, wheel chair tilting device 10 generally includes reversible drive motor 12 and wheel immobilizers or wheel locks 18 attached to base 14. In the embodiment shown in the figures, drive motor 12 is an electrical motor including electrical plug 22 and control 24. Drive motor 12 operates to raise and lower tilt bars 16. Tilt bars 16 include wheelchair frame locks 26 which are designed to secure handle frame members 68 of wheelchair 50 to tilt bars 16.

Reversible drive motor 12 may be any device known in the art suitable to pivot a wheel chair and its occupant to the desired reclining position. While drive motor 12 is shown in the figures to be an electrical motor, it is understood that any suitable drive mechanism may be utilized. Non-limiting examples of suitable drive mechanisms include a pneumatic or hydraulic drive mechanism, a belt driven mechanism or even a manually driven mechanism. Preferably, drive motor 12 is a screw drive motor such as those known in the art to adjust the angle of hospital beds.

Tilt bars 16 are lowered or raised by drive motor 12 and include frame locks 26. Tilt bars 16 may be of any shape or length suitable such that frame locks 26 may engage the handle frames 68 of wheel chair 50 at a location suitable to support wheel chair 50 while reclining and while in a reclined position. Non-limiting examples of suitable shapes included Y, T or U-shaped. Preferably, as shown in FIG. 2, tilt bars 16 are positioned in a Y shape. While the figures illustrate two tilt bars 16 it is understood that any number sufficient to support a wheel chair while reclining and in the reclined position may be utilized. For example, only one tilt bar or three or more tilt bars may be utilized.

Tilt bars 16 may be made of any material suitable to support the weight of a wheelchair and its occupant in a reclined position. Non-limiting examples of suitable materials include aluminum, steel, other metals, composite materials, thermoplastics, thermosets, wood or a combination thereof. Preferably, tilt bars 16 are constructed of aluminum.

Frame locks 26 may be any device suitable to secure frame portions 68 or alternately handles 66 of wheel chair 50 to tilt bars 16. Preferably, frame locks 26 are screw type clamps as are known in the art.

Wheel locks 18 may be any device designed to immobilize wheels 52. Preferably, wheel locks 18 secure wheels 52 to base 14 thereby providing a pivot point for wheel chair 50 when handle frame members 68 are secured to tilt bars 16 by locks 26. Non-limiting examples of suitable wheel immobilizers 18 include clamps, wheel chocks, detents, or hooks.

Figure 5A:
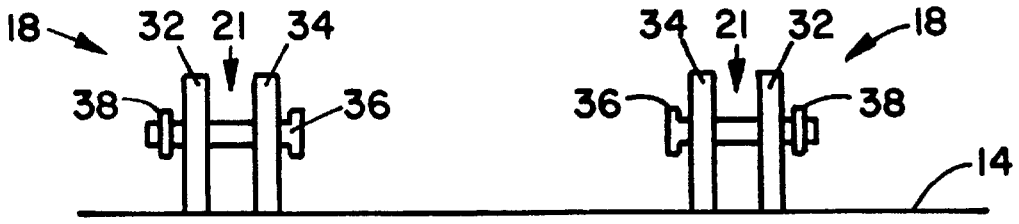
FIG. 5A is a side view of wheel locks 18 having outer bracket 32 and inner bracket 34 defining open areas 21 through which pin 36 is inserted and secured by fastener 38.
Figure 5B:
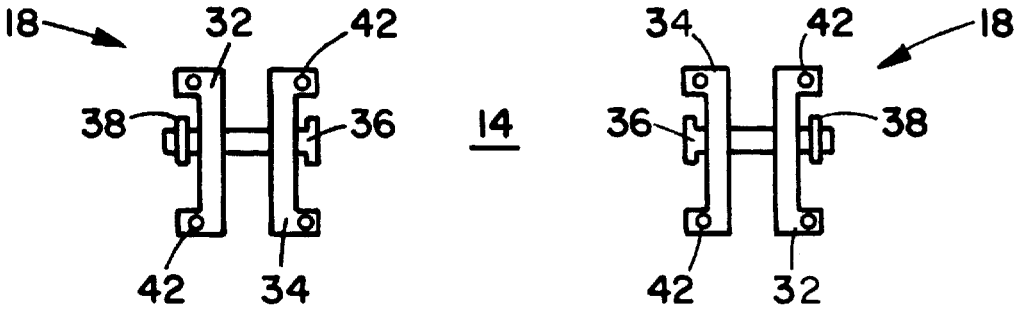
FIG. 5B is a top view of wheel locks 18 of FIG. 5A secured to base 14 by bolts or fasteners 42.

Referring now additionally to FIGS. 5A and 5B there are shown a side and top views respectively of one example of wheel immobilizers 18. In FIGS. 5A and 5B wheel locks 18 are shown to each include outer bracket 32, and inner bracket 34. Brackets 32 and 34 define open area 21 through which pin 36 is inserted and secured by fastener 38. Wheel locks 18 are secured to base 14 by any suitable means. Preferably, wheel locks 18 are secured to base 14 by bolts or screws 42.

Figure 6:
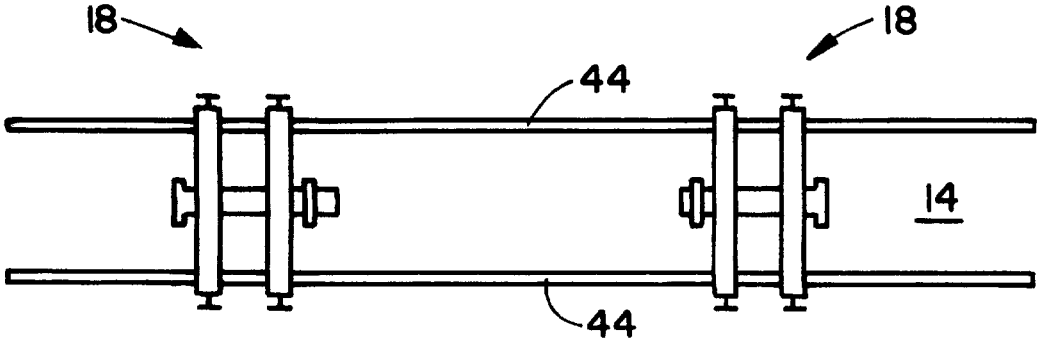
FIG. 6 is a top view of wheel locks 18 slidably positioned on tracks 44

Referring now to FIG. 6 there is shown a top view of how brackets 32 and 34 of wheel locks 18 may optionally be slidably positioned on tracks 44. Track 44 is secured to base 14 by any suitable means. Brackets 32 and 34 may travel the length of track 44 then be secured in place by any suitable means. The placement of wheel brackets 32 and 34 of locks 18 on tracks 44 allows the user to adjust the distance between brackets 32 and 34 as well as the distance between each wheel lock 18 so as to accommodate the various placements and thickness of wheels on a variety of wheelchairs.

Base 14 provides a surface on which reversible drive motor 12 and wheel locks 18 may be secured. Preferably, base 14 is a flooring surface. More preferably, base 14 is a sheet or tracks of suitable material such as aluminum, other metal, wood, or a combination thereof such that tilting device 10 is transportable.

In operation, wheel chair 50 is rolled onto base 14 such that wheels 52 are each positioned between brackets 32 and 34 of wheel locks 18. Optionally, the positions of wheel locks 18 are first adjusted along track 44 to accommodate the particular wheel chair being used. To secure the wheels to base 14 and to provide a pivot point on which chair 50 may be reclined, pin 36 is inserted through open area 21 over wheel 52 and secured by fastener 38. Tilt bars 16 are secured to handle frame members 68 of wheel chair 50.

The operator then operates reversible motor 12 via controller 24 to lower tilt bars 16 until wheel chair 50 and its occupant are at the desired angle of reclination. To return the wheel chair and occupant to an upright position, the operator then operates reversible motor 12 via controller 24 to raise tilt bars 16 until wheels 54 of chair 50 rest on base 14. Wheel locks 18 and handle locks 26 are unfastened and chair 50 is free to roll forward.

Figure 7:
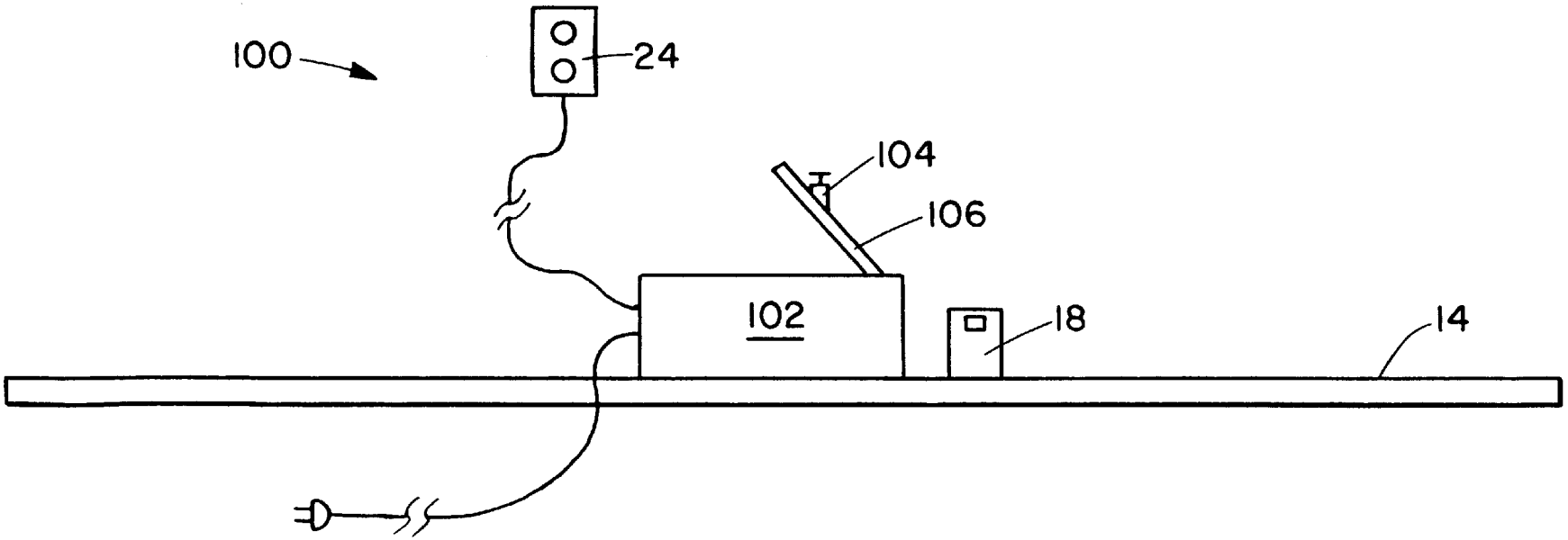
FIG. 7 is a side view of a second embodiment of a wheel chair tilting apparatus shown generally as 100 having drive motor 102, tilt bar 106, wheelchair frame lock 104 and wheel locks 18.
Figure 8:
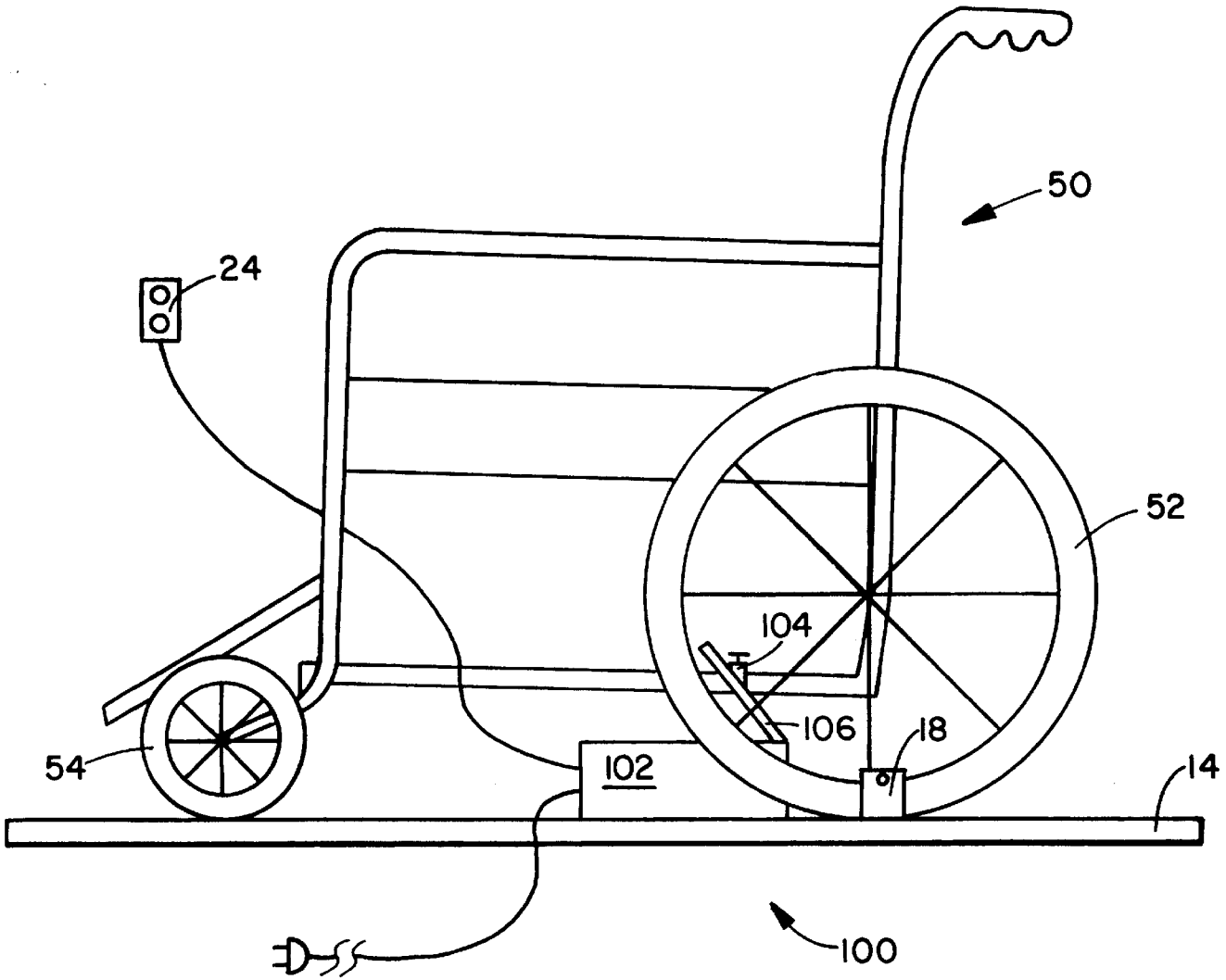
FIG. 8 is a side view of tilting device 100 of FIG. 7 with wheel chair 50 in an upright position.

Referring now to FIGS. 7 and 8 there is shown a second embodiment of the tilting device of the present invention. FIG. 7 is a side view of a second embodiment of wheel chair tilting apparatus 100, and FIG. 8 is a side view of tilting device 100 with wheel chair 50 in an upright position. Tilting device 100 is also designed to be used with any conventional wheel 50.

Wheel chair tilting device 100 generally includes reversible drive motor 102 and wheel locks 18 attached to base 14. Drive motor 102 is an electrical motor including electrical plug 22 and control 24. Drive motor 102 operates to raise and lower tilt bar 106 which includes wheel chair frame lock 104 which is designed to secure tilt bar 106 to the wheel chair frame.

Reversible drive motor 102 may be any device known in the art suitable to pivot a wheel chair and its occupant to the desired reclining position. While drive motor 102 is shown in the figures to be an electrical motor, it is understood that any suitable drive mechanism may be utilized. Non-limiting examples of suitable drive mechanisms include pneumatic or hydraulic drive mechanisms, a belt driven mechanism or even a manually driven mechanism. Preferably, drive motor 102 is a screw drive motor such as those known in the art to adjust the angle of hospital beds.

Tilt bar or bars 106 are extended or retracted by drive motor 102 and includes frame lock 104. Tilt bar 106 may be of any shape or length suitable to allow frame lock 104 to engage an interior frame member of wheel chair 50 at a location suitable to support wheel chair 50 while reclining and while in a reclined position. Tilt bar 106 may be made of any material suitable to balance the weight of wheel chair 50 and its occupant while in a reclined position. Non-limiting examples of suitable materials include aluminum, metal, or wood. Preferably, tilt bar 106 is constructed of aluminum. While the figures illustrate only one tilt bar 106 it is understood that any number of tilt bars 106 may be utilized as required.

Frame locks 104 may be any device suitable to secure tilt bar 106 to the framing of wheel chair 50. Preferably, frame locks 104 are screw clamps as are known in the art.

Wheel locks 18 are the same for tilting device 100 as described above for tilting device 10 in FIGS. 5A and 5B above. Optionally, wheel locks 18 of tilting device 100 may be positioned on tracks 44 as described above for tilting device 10 in FIG. 6 so that the distance between brackets 32 and 34 as well as the distance between each wheel lock 18 may be adjusted so as to accommodate the various placements and thicknesses of wheels on a variety of wheel chairs.

Base 14 may also be the same for tilting device 100 as described above for tilting device 10.

In the operation of tilting device 100, wheel chair 50 is rolled onto base 14 such that wheels 52 are each positioned between brackets 32 and 34 of wheel locks 18. Optionally, the positions of wheel locks 18 are first adjusted along track 44 to accommodate the particular wheel chair being used. To secure the wheels to base 14 and to provide a pivot point on which chair 50 may be reclined, pin 36 is inserted through open area 21 over wheel 52 and secured by fastener 38. Tilt bar 106 is secured to an inner frame member of wheel chair 50.

The operator then operates reversible motor 102 via controller 24 to raise tilt bar 106 until wheel chair 50 and its occupant are at the desired angle of reclination. To return the wheel chair and occupant to an upright position, the operator then operates reversible motor 102 via controller 24 to lower tilt bar 106 until wheels 54 of chair 50 rest on base 14. Wheel locks 18 and frame lock 104 are unfastened and chair 50 is free to roll backwards.

Figure 9:
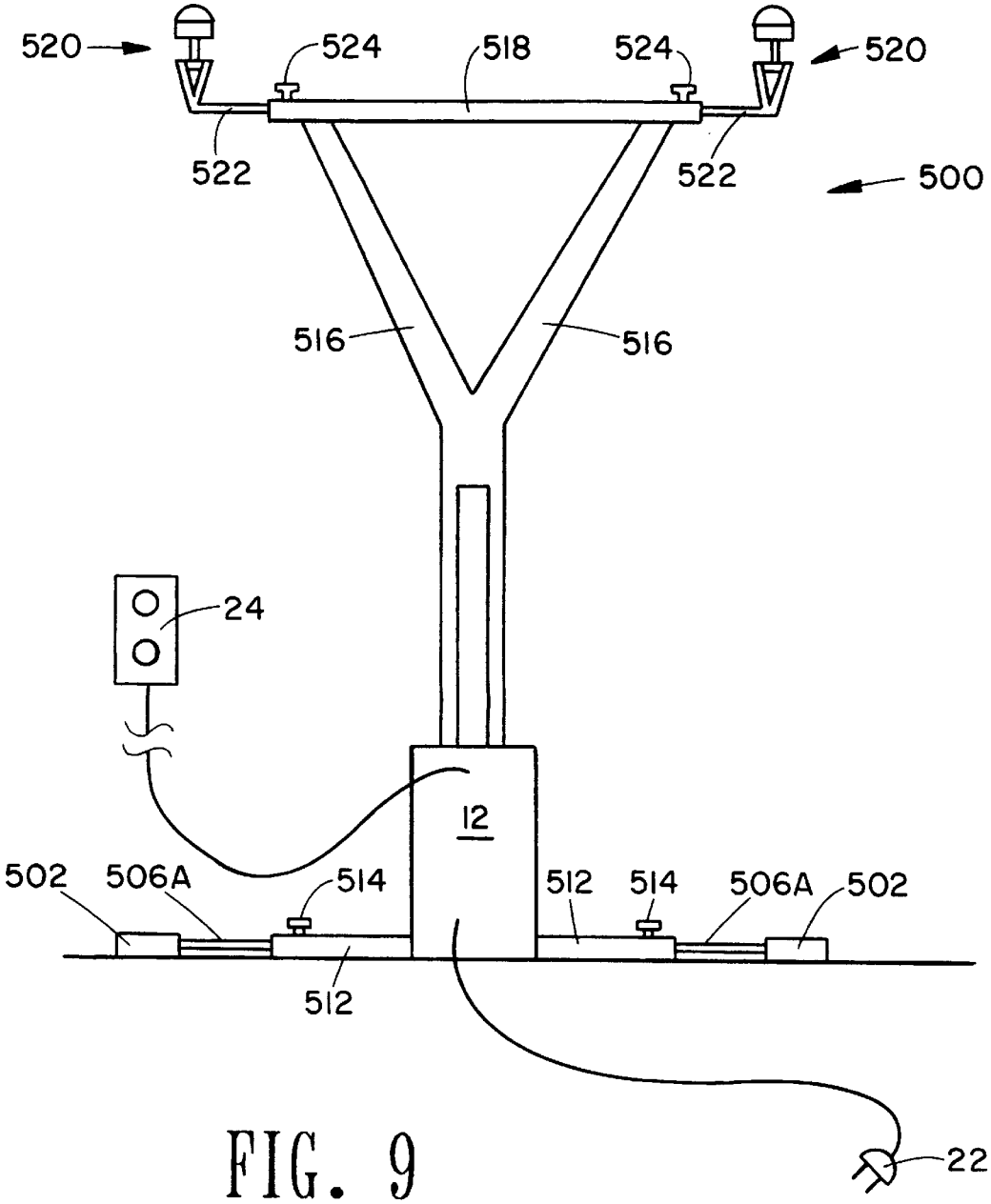
FIG. 9 is a rear view of a third embodiment of a wheel chair tilting device 500 having reversible motor 12, wheel tracks 502, tilt bars 516 and handle locks 520.
Figure 10:
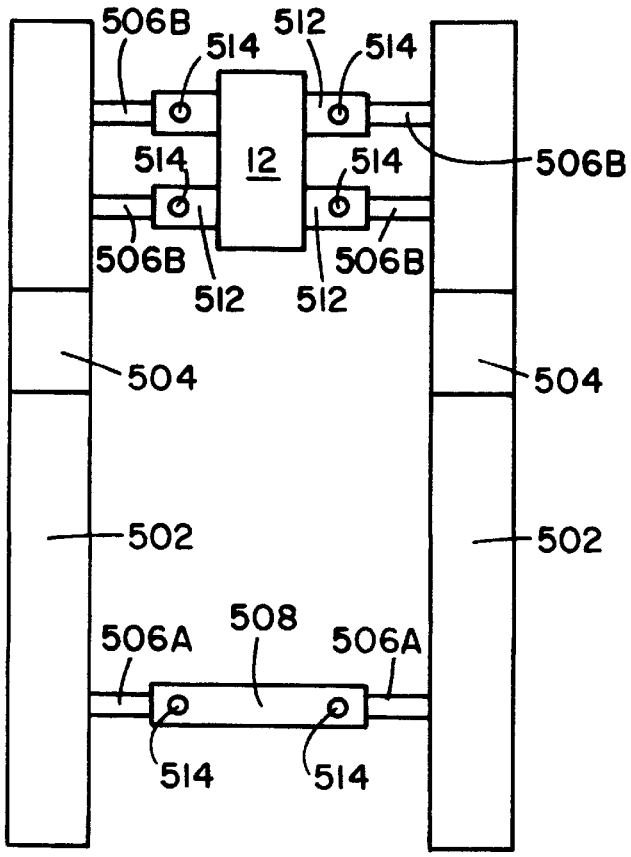
FIG. 10 is a top view of the wheel tracks 502 of tilting device 500 of FIG. 9 having spacing bars 508 and 512, positioning bars 506A and 506B and securing means 512.
Figure 11:
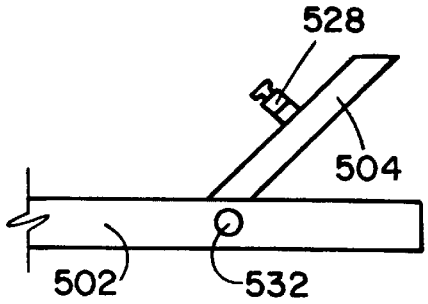
FIG. 11 is a side view of track 502 showing wheel stop 504 secured in an upright position and including wheel lock 528.
Figure 15:
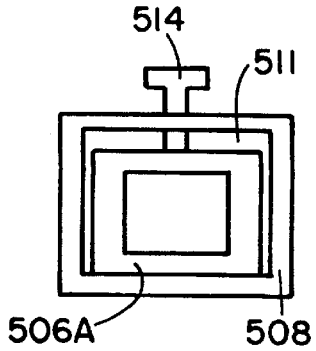
FIG. 15 is an end view of screw type securing means 514 threaded through spacing bar 508 to secure positioning bar 506A into place.
Figure 12:
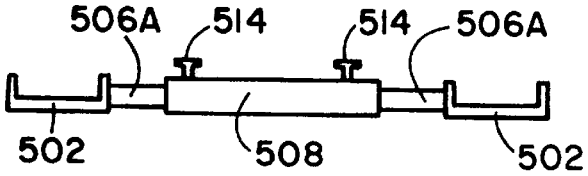
FIG. 12 is an end on view of tracks 502 of tilting device 500 showing positioning bars 506A and spacing bar 508 and securing means 514.
Figure 13:
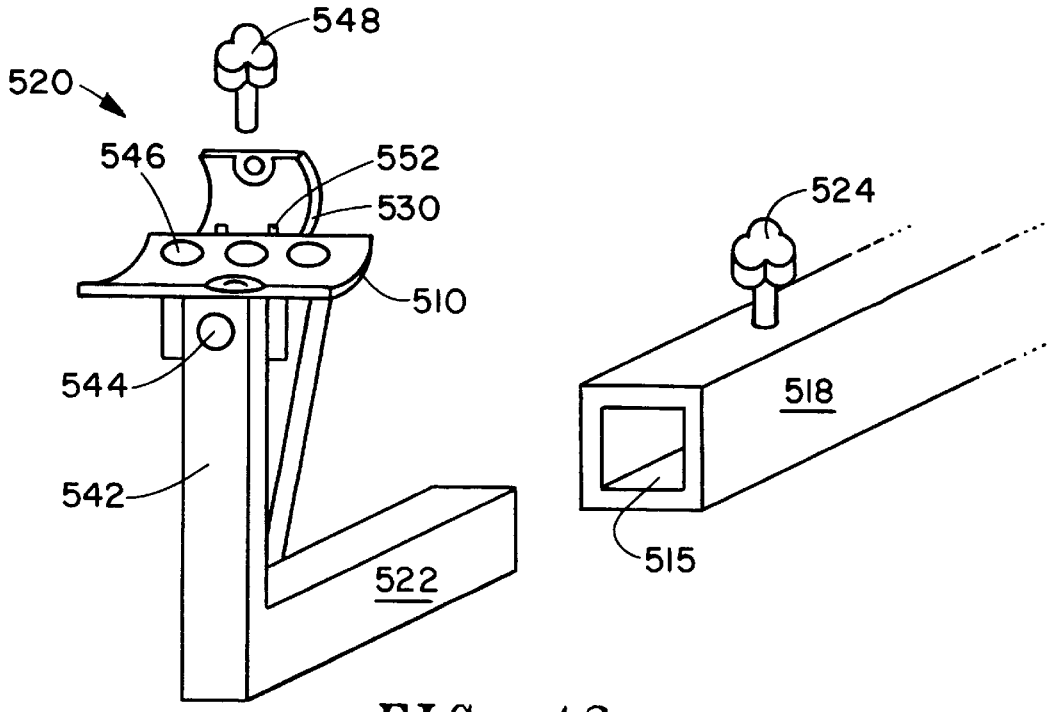
FIG. 13 is a perspective view of wheel chair handle locks 520 with positioning bar 522 and spacing bar 518 defining opening 515 for receiving positioning bar 522.
Figure 14:
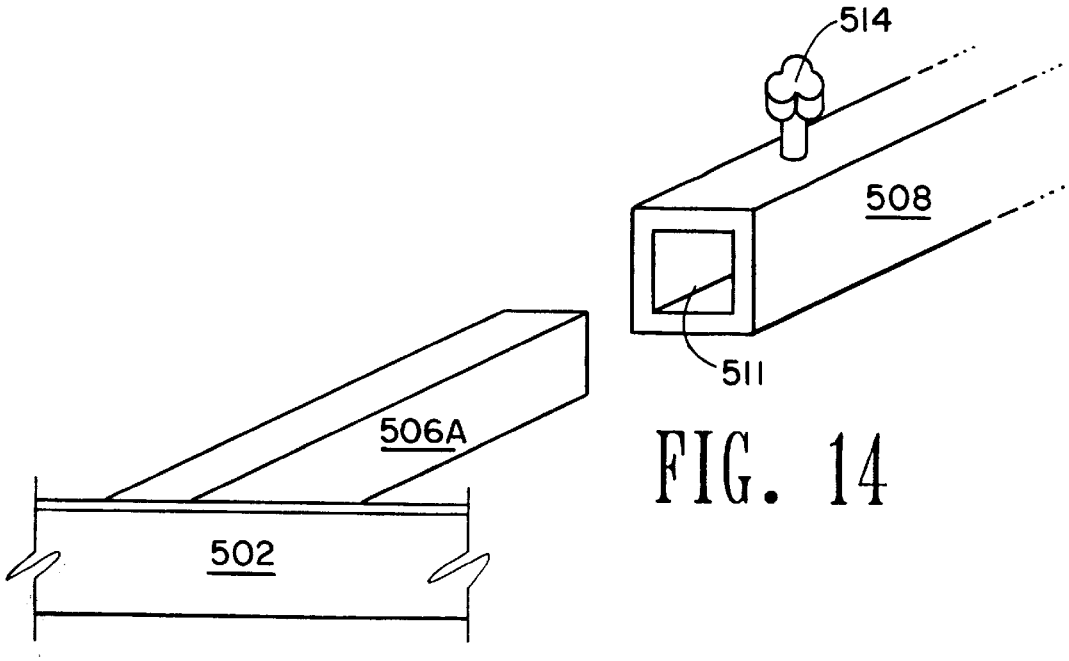
FIG. 14 is a perspective view of wheel track positioning bars 506A, fastening means 514 and spacing bar 508 defining opening 511 for receiving positioning bar 506A.
Figure 16:
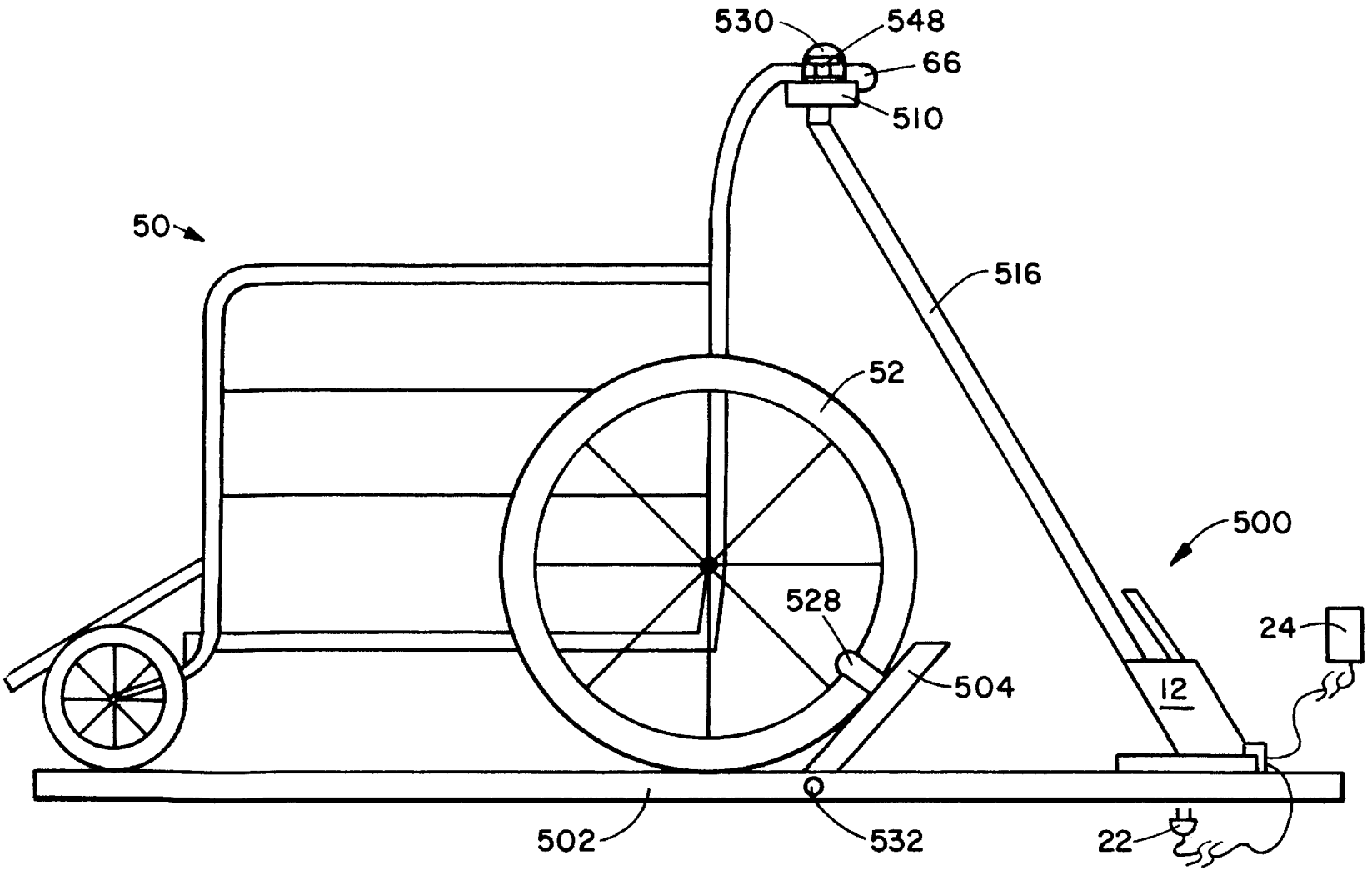
FIG. 16 is a side view of a third embodiment of a wheel chair tilting apparatus shown generally as 500 with wheel chair 50 in an upright position.

Referring now to FIGS. 9–15 there is shown another embodiment of a wheel chair tilting device of the present invention shown generally as 500 which is designed to be used with any wheel chair shown generally in the figures as 50. FIG. 9 is a rear view of tilting device 500, FIG. 10 is a top view of the wheel tracks 502 of tilting device 500, FIG. 11 is a side view of wheel stop 504, and FIG. 12 is an end on view of tracks 502 of tilting device 500 showing positioning bars 506A and spacing bar 508. FIG. 13 is a perspective view of wheel chair handle locks 520 with positioning bar 522 and spacing bar 518 defining opening 515 for receiving positioning bar 522. FIG. 14 is a perspective view of wheel track positioning bars 506A, fastening means 514 and spacing bar 508 defining opening 511 for receiving positioning bar 506A. FIG. 15 is an end view of screw type securing means 514 threaded through spacing bar 508 to secure positioning bar 506A into place. FIG. 16 is a side view of tilting device 500 with wheelchair 50 positioned thereon.

Referring first to FIGS. 9 and 10, tilting device 500 generally includes reversible drive motor 12 attached to spacing bars 512. Positioning bars 506A and 506B are attached to wheel tracks 502 and are designed to slide into spacing bars 508 and 512. Tracks 502 may be spaced apart at a specific distance by sliding positioning bars 506A and 506B into spacing bars 508 and 512 a desired distance. Securing means 514 are then tightened in order to hold tracks 502 at the desired spacing. Rear wheel stops 504 are positioned on tracks 502.

Reversible drive motor 12, which may be the same device as described for tilting device 10 above, is secured to spacing bars 512, and operates to raise and lower tilt bars 516. Tilt bars 516 attach to spacing bar 518. Wheel chair handle locks 520 are attached to positioning bars 522 which slide into spacing bar 518 and are held in place by securing means 524.

Tilt bars 516 may be of any shape or length suitable such that handle locks 520 may engage the grips of handles 66 of wheel chair 50 such that chair 50 may be supported while being tilted and while in a tilted position. Non-limiting examples of suitable shapes of tilt bar 516 include Y, T or U-shaped. Preferably, as shown in FIG. 9, tilt bars 516 are positioned in a Y-shape. While the figures illustrate two tilt bars 516, it is understood that any number sufficient to support a wheel chair while being tilted and when tilted may be utilized. Tilt bars 516 may be made of any material suitable to support the weight of a wheel chair and its occupant in a reclined position. Non-limiting examples of suitable materials include aluminum, steel, other metals, composite materials, thermoplastics, thermosets, wood, or a combination thereof. Preferably, tilt bars 516 are made of aluminum.

Wheel tracks 502 may be of any suitable shape to receive the wheels of a wheel chair and provide a surface for wheel stops 504. However, wheel stops 504 may be placed directly on a floor or other base. Referring now to FIG. 12, which is an end on view of tracks 502 of tilting device 500 showing positioning bars 506 and spacing bar 512, wheel tracks 502 may be somewhat U, dish shaped or contain sides to further guide wheels of wheel chair 50.

Wheel tracks 502 are preferably at least slightly wider than a wheel chair wheel. Preferably, wheel tracks 502 are between 3 and 10 inches wide. More preferably, wheel tracks 502 are between about 4 and about 8 inches wide. Wheel tracks 502 may be made of any suitable material. Non-limiting examples of suitable materials include aluminum, steel, other metals, composite materials, thermoplastics, thermosets, wood, or a combination thereof. Preferably, wheel tracks 502 are made of aluminum.

Wheel tracks 502 may be spaced apart by inserting positioning bars 506A, 506B into spacing bars 508 and 512 respectively. Referring now to FIG. 14, by way of illustration, there is shown a perspective view of spacing bar 508 defining opening 511 which accepts wheel track positioning bar 506A. Positioning bar 506A is then held in place by securing means 514 which is preferably a screw type fastener that is tightened down after positioning bar 506A has been inserted into spacing bar 508 a desired distance. Spacing bars 512 define a similar opening and accept positioning bars 506B. Positioning bars 506B are then held in place at the desired distance apart by securing means 514 in similar manner as bar 506A above.

While tilting device 500 is shown in the figures to include two spacing bars 512 to receive positioning bars 506B and to provide a stable base to secure reversible motor 12, it is understood that any number may be utilized to space tracks 502 a desired distance apart and that reversible motor 12 may be secured to the flooring or other base as described above. Positioning bars 506A, 506B and spacing bars 508 and 512 may be made of any suitable material. Non-limiting examples of suitable materials include aluminum, steel, other metals, composite materials, thermoplastics, thermosets, wood, or a combination thereof. Preferably, positioning bars 506A, 506B and spacing bars 508 and 512 are made of aluminum.

Referring now additionally to FIG. 11, there is shown a side view of rear wheel stops 504 positioned on tracks 502. Wheel stops 504 are hingedly engaged to tracks 502 and held in place by securing means 532. Preferably, wheel stops 504 are slightly narrower than tracks 502 so that when securing means 532 is released, wheel stops 504 lie flat against tracks 502 to aid in the storage and transportation of tilting device 500.

Wheel stops 504 include wheel immobilizers 528 which are designed to secure wheels 52 of wheel chair 50 to stops 504. Wheel locks 528 may be any device designed to so secure wheels 52 to stops 504 such as wheel locks 18 as described above. Wheel locks 528 may also be hooks or spring loaded hooks capable of securing wheels 52 of wheel chair 50 to stops 504.

Referring now to FIG. 13 there is shown a perspective view of chair handle locks 520. Handle locks 520 include Y member 542 to which lower portion 510 of handle locks 520 swivels on rotating member 544. In a preferred embodiment, lower portion 510 includes indentations 546 designed to receive the grip portion of handle 66 of wheel chair 50 and also contains a receiver for fastening means 548. Upper portion 530 of handle lock 520 is connected to lower portion 510 by hinges 552 and contains a passageway for fastening means 548. After grip portion of handle 66 of wheel chair 50 is placed in lower portion 510, upper portion 530 closes by way of hinges 552. Wheel chair handles 66 are then secured into handle lock 520 inserting then tightening fastening member 548, which is preferably a screw type fastener.

Y members 542 of handle locks 520 are secured to positioning bars 522. Spacing bar 518 defines opening 515 to accept positioning bars 522, which are held in place by securing means 524 which is preferably a screw type fastener that is tightened down after positioning bar 522 has been inserted into spacing bar 518 a desired distance.

Securing means 514 may be any device suitable to secure positioning bars 506A, 506B or 522 into a desired position along spacing bars 508, 512 or 518 thereby allowing tracks 502 or handle locks 520 to be spaced at a desired distance required to accept the wheels and hand grips of a particular wheel chair. Preferably, fastening means 514 is a screw type fastener that is tightened down after positioning bar 506A, 506B or 522 is inserted into spacing bars 508, 512 or 518 a desired distance. As an example and referring now to FIG. 15, there is shown an end view of screw type securing means 514 threaded through spacing bar 508 and positioned against positioning bar 506A after insertion into opening 511 to secure positioning bar 506A into place.

In operation, the distance between tracks 502 is adjusted as described above to accommodate the spacing of the wheels of a particular wheel chair 50. The tracks are secured apart by tightening fasteners 514. Rear wheel stops 504 are secured in the upright position as shown in FIG. 11. Wheel chair 50 is then rolled onto tracks 502 such that wheels 52 may be secured against wheel stops 504 by tightening securing means 528. Grips of wheel chair handles are placed into handle locks 520 and secured by fastener 548 as described above.

The operator operates reversible motor 12 via controller 24 to lower tilt bars 516, with rear wheels 52 acting as the fulcrum, until chair 50 and its occupant are at the desired angle of reclination. To return the wheel chair and its occupant to an upright position, the operator then operates reversible motor 12 via controller 24 to raise tilt bar 516 until wheels 54 of chair 50 rest on tracks 502. Wheel locks 528 and handle locks 520 are unfastened and wheel chair 50 is free to roll forward. If desired, device 500 may then be partially disassembled for transportation or storage by loosening securing means 514 such that positioning bars 506A and 506B of tracks 502 may be removed from spacing bars 508 and 512.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which this invention pertains.

We claim:

1. A device for pivoting a wheel chair, the wheel chair including a rear wheel, a wheel axle, and a handle frame having a handle, the device comprising:

a. at least one rear wheel immobilizer for securing at least one rear wheel of the wheel chair to form an immobilized rear wheel chair wheel;

b. a tilting assembly including at least one securing member for receiving a portion of the handle frame of the wheel chair; and c. a drive mechanism attached to the tilting assembly for extending and retracting the tilting assembly;

where when the handle frame of the wheel chair is secured into the tilting assembly, the immobilized rear wheel chair wheel acts as a pivot point such that when the tilting assembly is retracted the wheel chair pivots backwards on the wheel axle to a reclining position and when the tilting assembly is extended the wheel chair returns on the axle to an upright position.

2. The wheel chair pivoting device of claim 1 including two wheel immobilizers each secured to a track where the tracks are slidably engaged to each other such that the distance between the tracks may be adjusted.

3. The wheel chair device of claim 2 wherein the tracks include wheel stops and the wheel immobilizers are secured to the wheel stops.

4. The wheel chair pivoting device of claim 1 where the wheel immobilizer comprises an outer bracket and an inner bracket where the inner and outer bracket define a wheel receiving area for a wheel chair wheel and where a pin inserted through the brackets and over the wheel chair wheel immobilizes the wheel.

5. The wheel chair pivoting device of claim 1 where the securing means receives the wheel chair handle.

6. The wheel chair pivoting device of claim 5 where two securing means are slidably engaged to each other such that the distance between them may be adjusted.

7. The wheel chair pivoting device of claim 1 where the wheel immobilizers are selected from a group consisting of clamps, wheel chocks, hooks, and detents.

8. The wheel chair pivoting apparatus of claim 1 where the drive mechanism is selected from a group consisting of an electrical motor, a pneumatic drive, a hydraulic drive, a belt drive, and a manual drive mechanism.

9. A device for pivoting a wheel chair, the wheel chair including two rear wheels, a wheel axle, and a handle frame having two handles with handle grips, the device comprising:

a. two wheel immobilizers, each secured to a track where the tracks are slidably engaged to each other such that the distance between the tracks may be adjusted, for securing the rear wheels of the wheel chair to form two immobilized rear wheel chair wheels;

b. a tilting assembly including at least one securing member for receiving the handle grips of the wheel chair; and c. a drive mechanism comprising an electric motor attached to the tilting assembly for extending and retracting the tilting assembly;

where when the handle grips of the wheel chair are secured into the tilting assembly, the immobilized rear wheels act as a pivot point such that when the tilting assembly is retracted the wheel chair pivots backwards on the axle to a reclining position and when the tilting assembly is extended the wheel chair returns on the axle to an upright position.

10. A method for pivoting a wheel chair, the wheel chair including a rear wheel, a wheel axle, and a handle frame having a handle, the method comprising:

a. immobilizing at least one rear wheel of the wheel chair with at least one wheel immobilizer;

b. attaching a portion of the handle frame of the wheel chair to at least one tilting arm;

c. retracting the tilting arm with a drive mechanism so that the wheel chair pivots about the wheel axle and the immobilized rear wheel chair wheel acts as a fulcrum to position the wheel chair in a reclining position; and d. returning the wheel chair to an upright position by extending the tilting assembly.

11. The method of claim 10 including two wheel immobilizers each secured to a track where the tracks are slidably engaged to each other such that the distance between the tracks may be adjusted.

12. The method of claim 11 wherein the tracks include wheel stops and the wheel immobilizers are secured to the wheel stops.

13. The method of claim 10 wherein the wheel immobilizer comprises an outer bracket and an inner bracket where the inner and outer brackets define a wheel receiving area for a wheel chair wheel and where a pin inserted through the brackets and over the wheel chair wheel immobilizes the wheel.

14. The method of claim 10 wherein in step b. the handles of the wheel chair are attached to the at least one tilting arm.

15. The method of claim 10 wherein the at least one tilting arm includes two securing means slidably engaged to each other such that the distance between the securing means may be adjusted.

16. The method of claim 10 wherein the drive mechanism is selected from a group consisting of an electrical motor, a pneumatic drive, a hydraulic drive, a belt drive, and a manual drive mechanism.

17. The method of claim 10 wherein the at least one wheel immobilizer is selected from a group consisting of clamps, wheel chocks, hooks, and detents.

* * * * *